US008627542B2

(12) United States Patent
Kim et al.

(10) Patent No.: US 8,627,542 B2
(45) Date of Patent: Jan. 14, 2014

(54) ROBOT CLEANER WITH IMPROVED DUST COLLECTOR

(75) Inventors: Dong Won Kim, Suwon-si (KR); Hoon Wee, Yongin-si (KR); Jun Pyo Hong, Suwon-si (KR); Yong Tae Kim, Yongin-si (KR); Woo Ram Chung, Hwawseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 153 days.

(21) Appl. No.: 12/076,780

(22) Filed: Mar. 21, 2008

(65) Prior Publication Data

US 2008/0235897 A1 Oct. 2, 2008

(30) Foreign Application Priority Data

Mar. 27, 2007 (KR) ..... 10-2007-0030059
Oct. 4, 2007 (KR) ..... 10-2007-0099735

(51) Int. Cl.

| | |
|---|---|
| ***A47L 5/00*** | (2006.01) |
| ***A47L 9/10*** | (2006.01) |
| ***A47L 9/20*** | (2006.01) |
| ***A47L 5/10*** | (2006.01) |
| ***A47L 5/26*** | (2006.01) |

(52) U.S. Cl.
USPC ..... 15/319; 15/340.1; 15/353; 15/383

(58) Field of Classification Search
USPC ..... 15/319, 340.1, 353, 383
See application file for complete search history.

(56) References Cited

U.S. PATENT DOCUMENTS

2007/0204426 A1 9/2007 Nakagawa et al.

FOREIGN PATENT DOCUMENTS

| | | | |
|---|---|---|---|
| CN | 2153322 | | 1/1994 |
| CN | 1669514 | | 9/2005 |
| CN | 1833594 | | 9/2006 |
| CN | 1833594 | A * | 9/2006 |
| DE | 102 42 257 | | 4/2003 |
| EP | 1 582 132 | | 10/2005 |
| ES | 2 238 196 | | 8/2005 |
| GB | 2 344 778 | | 6/2000 |
| JP | 8-89451 | | 4/1996 |
| JP | 08089451 | A * | 4/1996 |
| JP | 2001-258807 | | 9/2001 |
| JP | 2003-180587 | | 7/2003 |
| KR | 10-2006-0027701 | | 3/2006 |
| WO | 03/024292 | | 3/2003 |
| WO | 2005/055795 | | 6/2005 |
| WO | 2005/092168 | | 10/2005 |
| WO | WO 2005092168 | A1 * | 10/2005 |

OTHER PUBLICATIONS

European Search Report for Corresponding European Application 08152001.7-2316; dated Jan. 17, 2009.

(Continued)

*Primary Examiner* — Bryan R Muller
(74) *Attorney, Agent, or Firm* — Staas & Halsey LLP

(57) ABSTRACT

A robot cleaner having a configuration capable of improving an ability to collect dust, etc. is disclosed. The robot cleaner includes a suction hole to suction dust, a dust collector to receive the dust suctioned through the suction hole, and a rotating brush provided at a side of the suction hole. The robot cleaner is configured to sweep up and collect the dust into the dust collector by a drive force of the rotating brush.

3 Claims, 9 Drawing Sheets

(56) References Cited

OTHER PUBLICATIONS

Partial European Search report issued Sep. 15, 2008 in corresponding European Patent Application No. 08152001.7.
Chinese Office Action for corresponding Chinese Application 200810086827.3; issued Aug. 7, 2009.
Korean Office Action dated Nov. 14, 2011 issued in corresponding Korean Patent Application No. 10-2007-0030059.
US Office Action dated Jul. 26, 2012 issued in copending U.S. Appl. No. 13/137,105.
Notice of Allowance issued in copending U.S. Appl. No. 13/137,105 mailed Jan. 17, 2013.
US Office Action mailed Sep. 18, 2012 issued in the corresponding U.S. Appl. No. 12/076,780.
U.S. Office Action issued Aug. 26, 2013 in copending U.S. Appl. No. 13/864,852.

* cited by examiner

ROBOT CLEANER WITH IMPROVED DUST COLLECTOR

CROSS-REFERENCE TO RELATED APPLICATIONS

This application claims the benefit of Korean Patent Application No. 2007-0030059, filed on Mar. 27, 2007 in the Korean Intellectual Property Office and Korean Patent Application No. 2007-0099735, filed on Oct. 4, 2007 in the Korean Intellectual Property Office, the disclosure of which is incorporated herein by reference.

BACKGROUND

1. Field

The present invention relates to a robot cleaner, and, more particularly, to a robot cleaner configured to achieve an improved cleaning performance.

2. Description of the Related Art

A cleaner is an appliance to eliminate dirt and clean a room. Generally used is a vacuum cleaner to suction dirt by use of a suction force generated from a low-pressure unit.

Recently, the development of a robot cleaner is underway. The robot cleaner eliminates dirt from the floor by a self-running function thereof without a user's labor.

One example of the robot cleaner is disclosed in Korean Patent Laid-Open Publication No. 10-2006-0027701.

The robot cleaner disclosed in the above Publication includes a body case having a dust or dirt suction hole and an air-discharge hole, a fan motor installed in the body case to generate a suction force, a filter container installed in front of the fan motor and receiving a filter to collect dust or dirt suctioned by operation of the fan motor, a suction head provided at the bottom of the body case and connected with the filter container through a connection tube to suction dust or dirt from the floor, a brush rotatably disposed in the suction head to sweep up dust or dirt on the floor, and an air-purifying filter installed in the body case to purify air, suctioned into the robot cleaner together with the dust or dirt, prior to being discharged through the air-discharge hole.

The most important factors having an effect on a cleaning performance of the robot cleaner are the suction force generated by the fan motor and the brush mounted at a side of the suction hole. The greater the suction force, the greater the cleaning performance. Also, when suctioning dust after scattering upward the dust by use of the brush, an improved cleaning performance can be anticipated.

However, the robot cleaner has a problem of not being able to adopt a large-size fan motor providing a high suction force because it should be configured to have a small size and low height to clean under furniture, such as a sofa, and has only a restricted battery capacity.

As a result, the robot cleaner generally uses a fan motor having a significantly lower capacity (approximately 30~100 W) than a capacity (approximately 600 W) of a conventional vacuum cleaner, and has a limit to suction heavy dust into the filter by use of the low-capacity fan motor.

More specifically, in operation of the robot cleaner to deliver dust, scraps, etc. on the floor to the filter, after the dust is scattered upward from the floor by the brush, the scattered dust is suctioned into and collected by the filter mounted in the filter container by passing through the suction head and the connection tube extending vertically from the suction head under operation of the fan motor. However, since the low-capacity fan motor generates an inferior suction force, it is difficult for the robot cleaner to exhibit a satisfactory cleaning performance.

In the robot cleaner having the low-capacity fan motor, it is necessary to reduce a sectional area of the suction hole for the sake of strengthening the suction force. However, this deteriorates an ability to collect bulky or various shapes of dust. Also, when increasing the sectional area of the suction hole to improve the cleaning performance of the robot cleaner by a sweeping operation using the brush, there is a problem of a deterioration in the suction force generated by the fan motor.

SUMMARY

Accordingly, it is an aspect of the embodiments to provide a robot cleaner having a configuration capable of improving an ability to collect dust, etc.

Additional aspects and/or advantages of the invention will be set forth in part in the description which follows and, in part, will be obvious from the description, or may be learned by practice of the invention.

In accordance with the invention, the above and/or other aspects can be achieved by the provision of a robot cleaner, including: a suction hole to suction dust; a dust collector to receive the dust suctioned through the suction hole; and a rotating brush provided at a side of the suction hole, and the robot cleaner may be configured to sweep up and collect the dust into the dust collector by a drive force of the rotating brush.

The dust collector may include a plurality of collecting regions including a first collecting region defined in a lower part of the dust collector, and a second collecting region defined in an upper part of the dust collector.

The robot cleaner may further include a blower to generate a suction force to be applied into the dust collector, and the dust collector may be divided into a plurality of collecting regions to receive dust, and a part of the plurality of collecting regions is not in direct communication with the blower.

The plurality of collecting regions may be separated from one another by vertical partitions, and may include a first collecting region communicating directly with the blower and a second collecting region not communicating directly with the blower.

The dust collector may include a dividing member to prevent the dust received in the second collecting region from flowing backward into the first collecting region.

The first collecting region and the second collecting region may communicate with each other by a vertically extending connection passage.

The dust collector may include a backflow preventing member to prevent the dust in the dust collector from being discharged through the suction hole.

The robot cleaner may further include a blower to provide a drive force required to introduce the dust into the dust collector, and the backflow preventing member may be adapted to open or close the suction hole according to an operation of the blower.

The backflow preventing member may be coupled to an upper surface of the first collecting region and is pivotally rotated by a suction force of the blower.

The robot cleaner may further include a guide portion to guide the dust swept up by the rotating brush into the suction hole.

In accordance with another aspect of the present invention, there is provided a robot cleaner, including: a body having a suction hole to suction dust; a blower provided in the body to generate a suction force; a rotating brush provided at a side of the suction hole; and a dust collector to receive the dust suctioned through the suction hole, the dust collector including at least one first collecting region to receive dust swept up by the rotating brush, and a second collecting region to receive dust introduced by interaction of the rotating brush and the blower.

The dust collector may include a plurality of suction slots communicating with the suction hole, at least one suction slot not being affected by the suction force of the blower.

The plurality of suction slots may include at least one first suction slot communicating with the at least one first collecting region to suction dust only by operation of the rotating brush, and a second suction slot communicating with the second collecting region to suction dust by operations of the rotating brush and the blower.

The second collecting region may be located above the first collecting region.

The dust collector may include a backflow preventing member to prevent the dust in the dust collector from being discharged through the suction hole.

The suction hole and a lower surface of the first collecting region may be provided at a bottom of the body to be located close to the floor.

The robot cleaner may further include a guide portion to guide the dust swept up by the rotating brush into the suction hole.

The foregoing and/or other aspects are achieved by providing a robot cleaner, including: a body including a suction hole to suction dust; a blower provided in the body and generating a suction force to suction dust; a rotating brush provided at the suction hole to introduce dust into the suction hole; and a dust collector receiving the dust suctioned through the suction hole, the dust collector including at least one first collecting region directly connected to the suction hole and in communication with the rotating brush, and a second collecting region receiving dust introduced through the suction hole and in direct communication with the blower such that the dust received at the second collecting region is received through an interaction of the rotating brush and the blower.

The second collecting region may communicate with the first collecting region through a connecting passage.

The at least one first collecting region may be adjacent to and partitioned from the second collecting region.

The second collecting region may include communicating slots communicating with the blower.

The at least one first collecting region and the second collecting region may each include a suction slot in communication with the suction hole.

The second collecting region may include a dividing member inclined upward toward a rear side of the second collecting region.

The second collecting region may include a lower collecting region and an upper collecting region, the dividing member dividing the lower collecting region from the upper collecting region.

The at least one first collecting region and the second collecting region may each include at least one wall piece having a predetermined height to prevent dust from being discharged to the outside through the suction slot.

BRIEF DESCRIPTION OF THE DRAWINGS

These and/or other aspects and advantages of the embodiments of the invention will become apparent and more readily appreciated from the following description of the embodiments, taken in conjunction with the accompanying drawings, of which.

DETAILED DESCRIPTION OF THE EMBODIMENTS

Figure 1:
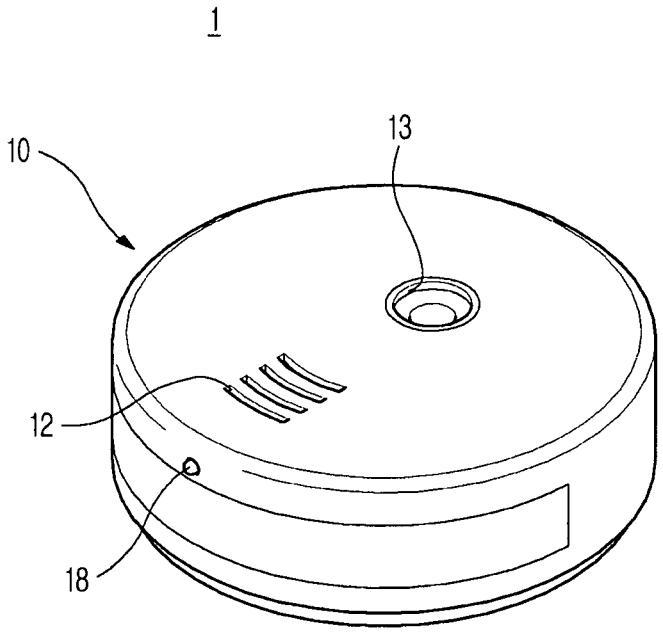
FIG. 1 is a perspective view of a robot cleaner according to the present embodiments.

Reference will now be made in detail to the embodiments, examples of which are illustrated in the accompanying drawings, wherein like reference numerals refer to like elements throughout. The embodiments are described below to explain the present invention by referring to the figures.

Figure 2:
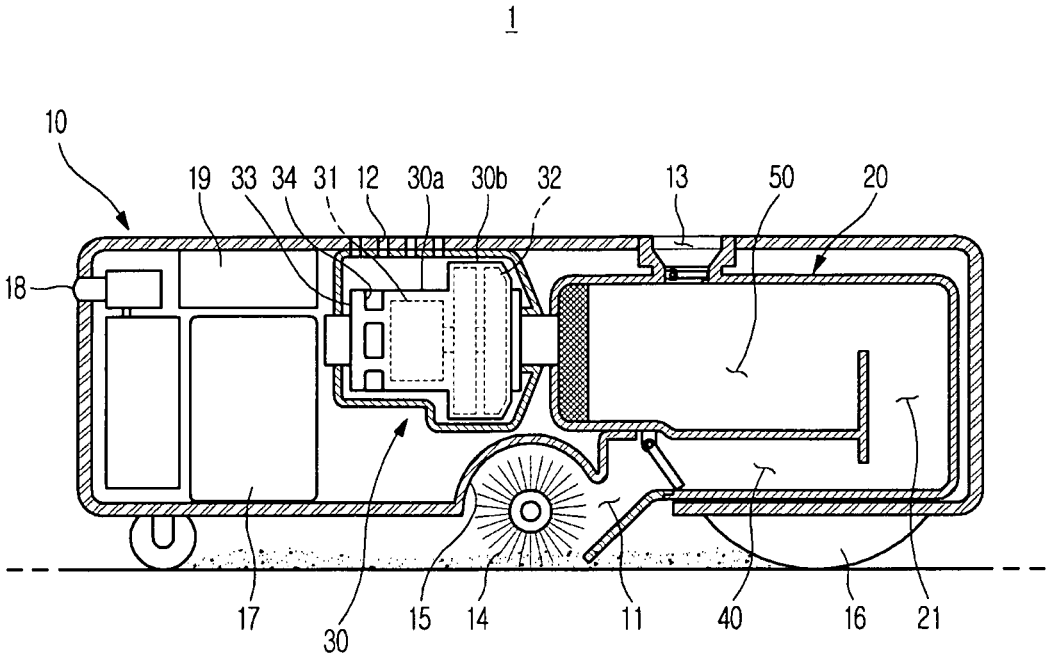
FIG. 2 is a sectional view illustrating the overall configuration of a robot cleaner according to a first embodiment.

FIG. 1 is a perspective view of a robot cleaner according to the present embodiments, and FIG. 2 is a sectional view illustrating the overall configuration of a robot cleaner according to a first embodiment.

The robot cleaner according to the first embodiment, as shown in FIGS. 1 and 2, includes a body 10 defining an outer appearance of the cleaner 1, a dust collector 20 installed in the body 10 to collect dust, scraps, etc. (hereinafter, wholly referred to as "dust") therein, and a blower 30 to generate a suction force required to suction the dust in communication with the dust collector 20.

The body 10 defining the outer appearance is perforated, in a bottom surface thereof, with a suction hole 11 to suction dust from the floor. Also, the body 10 is perforated, in a top surface thereof, with air-discharge slots 12 to discharge air suctioned by the blower 30 to the outside of the body 10 and a dust-discharge hole 13 to discharge the dust collected in the dust collector 20 into a docking station (not shown) when the robot cleaner 1 docks with the docking station.

A rotating brush 14 is provided at the bottom of the body 10, to sweep up or scatter dust on the floor upward, in order to improve the suction efficiency of dust.

The rotating brush 14 has an elongated cylindrical shape, and is rotatably mounted to be partially exposed from the bottom surface of the body 10. In order to receive the brush 14, the body 10 has an arc-shaped seating recess 15 having a predetermined depth to receive the rotating brush 14.

The suction hole 11 is formed between a lower surface of the body 10 and one end of the seating recess 15 and has a predetermined width approximately equal to a length of the rotating brush 14, to allow the dust swept or floated upward by operation of the rotating brush 14 to be suctioned into the dust collector 20 through the suction hole 11.

The body 10 is also provided at the bottom thereof with a pair of electric-powered wheels 16 to allow the robot cleaner 1 to run on the floor. The pair of electric-powered wheels 16 can be selectively driven by a drive motor (not shown) provided to rotate the drive wheels 16 individually, thereby enabling rectilinear and rotating movements of the body 10 and consequently allowing the robot cleaner 1 to run in a desired direction.

Additionally, provided in the body 10 are a controller 19 to control operation of the robot cleaner 1, a charging battery 17 to supply power required for operation of the robot cleaner 1, and an obstacle detecting sensor 18, such as an infrared sensor, ultrasonic sensor, etc., installed at a side surface, for example, of the body 10 to avoid an obstacle.

The obstacle detecting sensor 18 measures a distance between the robot cleaner 1 and an obstacle in the vicinity of the robot cleaner 1, such as walls or furniture, and transmits the measured information to the controller 19. The controller 19 controls operations of the pair of electric-powered wheels 16 on the basis of the transmitted information.

The blower 30 to generate the suction force to be applied into the dust collector 20 includes a motor section 30*a* for the installation of a motor 31 and a blowing fan section 30*b* for the installation of a blowing fan 32. The motor 31 to generate power and the blowing fan 32 to generate a blowing force upon receiving the power of the motor 31 are encased in a single case 33.

The blowing fan 32 of the blower 30 according to the present embodiment is a centrifugal fan to suction air in an axial direction and to discharge the suctioned air in a radial direction. The air discharged from the blowing fan 32 first cools the motor 31 and then, is discharged radially through a plurality of vent holes 34 perforated in the motor section 30*a*. Finally, the air is discharged to the outside of the body 10 through the air-discharge slots 12 perforated in the top surface of the body 10.

The dust collector 20 is installed in the body 10 at a side of the blower 30, to receive the dust suctioned through the suction hole 11.

The dust collector 20 according to the first embodiment has an approximately rectangular box shape. The dust collector 20 has a bottom portion communicating with the suction hole 11 and a side portion communicating with the blower 30 to suction and collect the dust from the floor by use of a suction force generated by the blower 30.

The interior of the dust collector 20 is divided into several storage regions to allow the dust to be sorted and collected according to different weights thereof. More specifically, the dust collector 20 has a first collecting region 40 defined in a lower part thereof to receive relatively heavy dust, a second collecting region 50 defined in an upper part thereof to receive relatively light dust, and a connection passage 21 to communicate the first and second collecting regions 40 and 50 with each other.

The dust collector 20 is provided therein with a dust-amount sensor (not shown) to sense the amount of dust collected in the dust collector 20. If a predetermined amount of dust is accumulated in the dust collector 20, the robot cleaner 1 will run to the docking station (not shown) to empty the dust collector 20.

Figure 3:
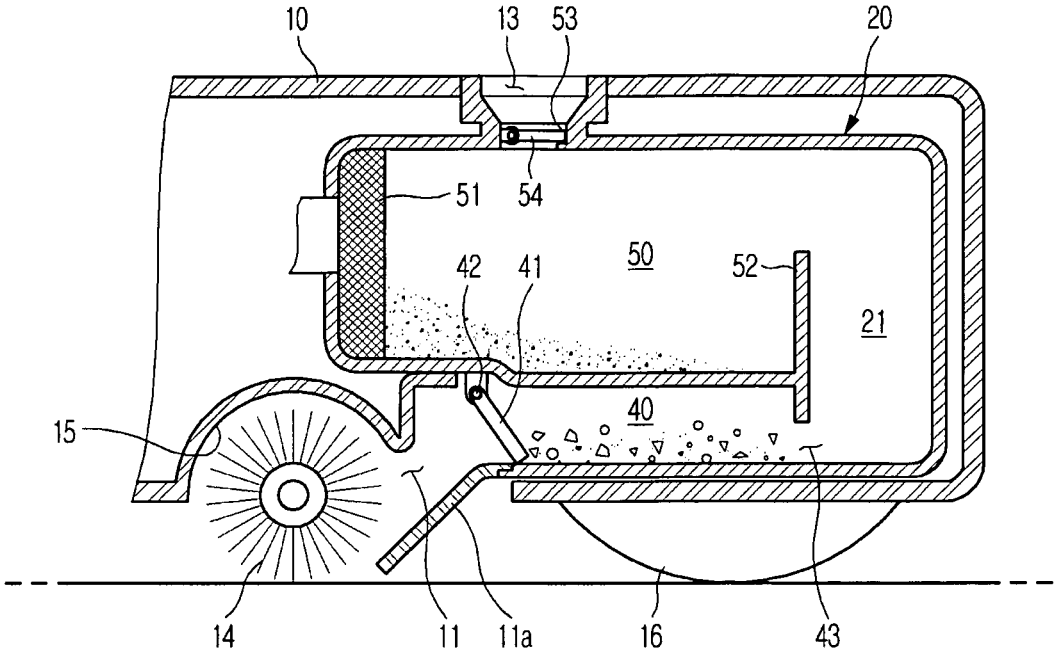
FIG. 3 is a sectional view illustrating important parts of the robot cleaner according to the first embodiment.

FIG. 3 is a sectional view illustrating important parts of the robot cleaner according to the first embodiment.

As shown in FIG. 3, the first collecting region 40 has an approximately horizontal lower surface and the suction hole 11 is located adjacent to the floor. Therefore, once the air containing dust is introduced into the suction hole 11, the air flows horizontally in the first collecting region 40.

The suction hole 11 is provided with a guide portion 11*a*, which is inclined downward close to the floor, to guide the dust swept up by the rotating brush 14 into the first collecting region 40.

With the use of the guide portion 11*a*, relatively heavy dust, which is difficult to be suctioned into the dust collector 20 by use of only the suction force generated by the blower 30, can be easily swept up by rotations of the rotating brush 14, and introduced directly into the first collecting region 40. As a result, the first collecting region 40 can function similarly to a dust pan, to improve cleaning efficiency of the robot cleaner 1.

The first collecting region 40 is provided, at an upper surface thereof near the suction hole 11, with a backflow preventing member 41 to prevent the dust collected in the dust collector 20 from flowing backward and being discharged through the suction hole 11.

The backflow preventing member 41 is coupled to the upper surface of the first collecting region 40 by a hinge 42, for example, but may be coupled by any other type of fastening device that allows the backflow preventing member 41 to rotate to open/close the suction hole 11.

The backflow preventing member 41 serves to close the suction hole 11 when the robot cleaner 1 is not operated. As soon as the robot cleaner 1 begins a cleaning operation, the backflow preventing member 41 is pivotally rotated in an air suction direction by the suction force of the blower 30 to open the suction hole 11, thereby allowing dust to be suctioned into the dust collector 20.

Also, upon completing the operation of the robot cleaner 1, the backflow preventing member 41 is returned to an original position thereof to close the suction hole 11, thereby preventing the collected dust from being discharged to the outside through the suction hole 11.

Although the present embodiment illustrates the backflow preventing member 41 that is pivotally rotatable by the suction force of the blower 30, it will be appreciated that the backflow preventing member may be adapted to open or close the suction hole by a separate drive device.

The first collecting region 40 is provided at a distal end thereof with an accelerating portion 43 as a flow path having a reduced sectional area. The accelerating portion 43 causes a reduced air-suction sectional area and an increased flow rate of air having passed through the first collecting region 40, thereby allowing the suctioned air containing dust to be moved upward into the second collecting region 50 with an increased force.

The second collecting region 50 defined above the first collecting region 40 is in communication with the first collecting region 40 through the connection passage 21, and is used to collect relatively light dust therein. The second collecting region 50 receives a filter 51 in one side thereof to purify the air suctioned by the blower 30 to discharge the purified air. Provided at an opposite side of the second collecting region 50 is a dividing member 52 protruding upward from the bottom of the second collecting region 50 to prevent the dust collected in the second collecting region 50 from flowing backward into the first collecting region 40 through the connection passage 21.

Consequently, relatively light dust is moved into the second collecting region 50 after passing through the first collecting region 40 by the suction force of the blower 30. In this case, the first collecting region 40 serves as a connection path to guide the light dust into the second collecting region 50, and the dust can be moved upward through the connection passage 21 vertically defined between the first collecting region 40 and the second collecting region 50 to thereby be collected in the second collecting region 50.

The second collecting region 50 has a communicating hole 53 perforated in a top surface thereof to communicate with the dust-discharge hole 13, and an opening/closing device 54 to open or close the communicating hole 53. Once the robot cleaner 1 docks with the docking station, the opening/closing device 54 opens the communicating hole 53, to remove the dust collected in the dust collector 20 through the communicating hole 53 and the dust-discharge hole 13.

Figure 5:
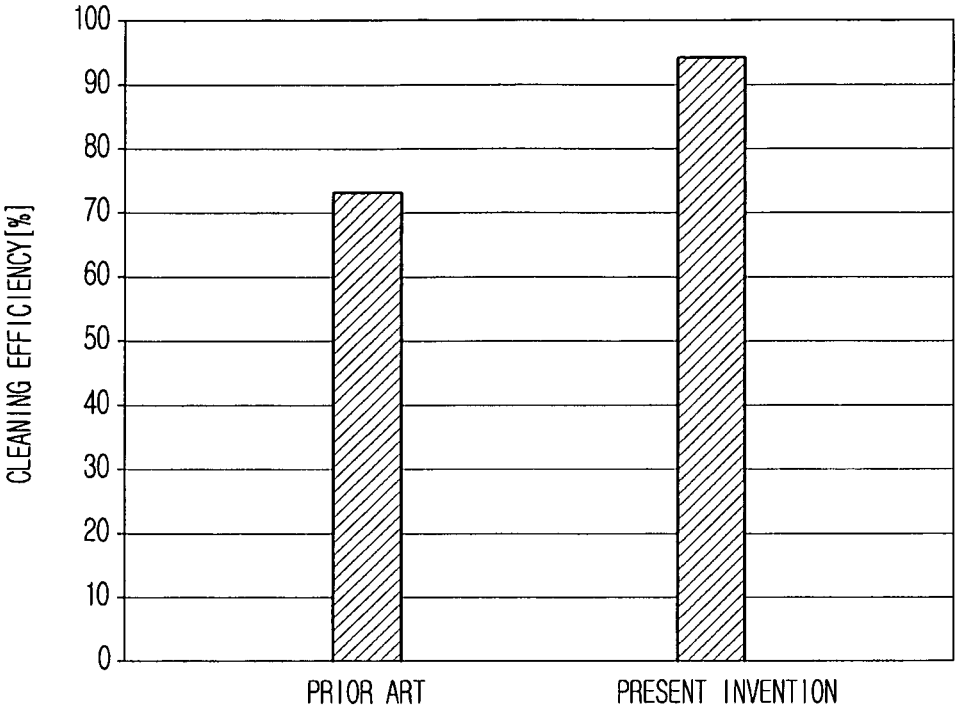
FIG. 5 is a graph comparing a cleaning performance of the robot cleaner according to the present embodiment with that of a conventional robot cleaner.

FIG. 5 is a graph comparing a cleaning performance of the robot cleaner according to the present embodiments with that of a conventional robot cleaner.

Here, it is noted that FIG. 5 illustrates experimental results obtained using a blower having a significantly lower capacity (approximately 100 W) than a capacity (approximately 600 W) of a general vacuum cleaner.

Also, it is noted that a cleaning efficiency illustrated in the above comparison graph is represented by a percentage of the weight of dust collected in a dust collector in relation to the weight of dust dispersed in a predetermined area.

In the case of the conventional robot cleaner previously disclosed herein, which is operated such that, after dust on the floor is scattered upward by the brush, the scattered dust is collected into the filter by passing through the suction head and the connection tube extending vertically from the suction head, as shown in FIG. 5, it has a cleaning efficiency of 72%. As compared to the conventional robot cleaner, the robot cleaner according to the present embodiments, in which relatively heavy dust is swept up into the first collecting region by rotations of the rotating brush and relatively light dust is collected into the second collecting region by the suction force of the blower, can achieve a cleaning efficiency of 95%.

In conclusion, it can be said that the robot cleaner according to the present embodiments can achieve an improved cleaning efficiency as compared to the prior art.

Hereinafter, operation of the robot cleaner according to the first embodiment will be described with reference to FIGS. 3 and 4.

Figure 4:
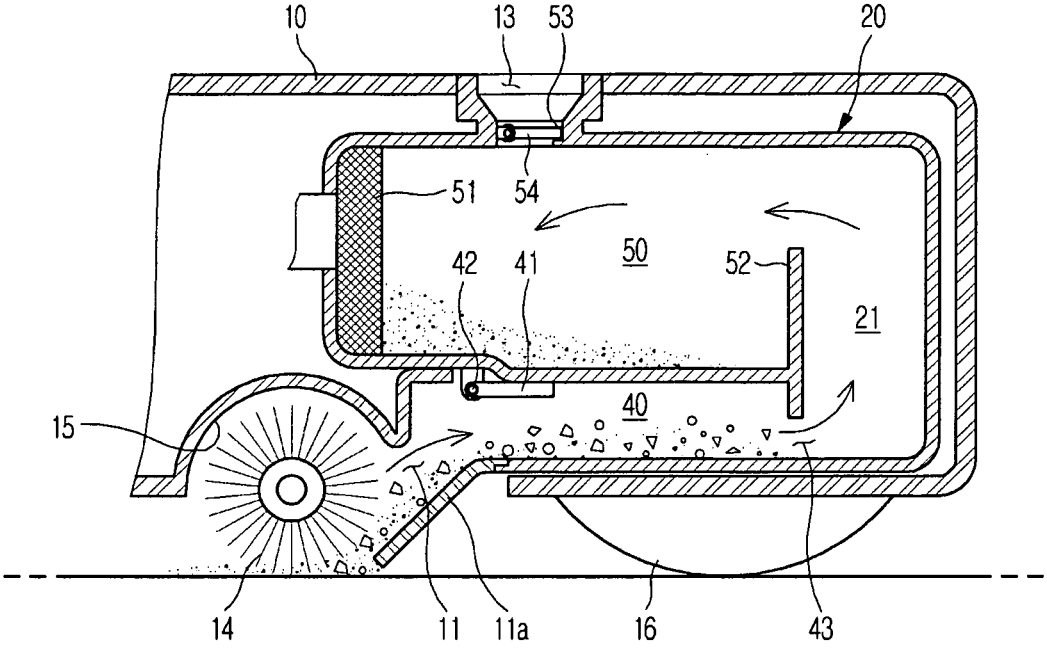
FIG. 4 is a sectional view illustrating operation of the robot cleaner according to the first embodiment.

FIG. 4 is a sectional view illustrating operation of the robot cleaner according to the first embodiment.

If a user starts the robot cleaner 1, the blower 30 and the rotating brush 14 are operated. With a suction force generated by the blower 30, as shown in FIG. 4, the backflow preventing member 41 provided in the first collecting region 40 is pivotally rotated to open the suction hole 11 to allow dust to be suctioned into the dust collector 20.

In this case, by rotations of the rotating brush 14, relatively light dust is scattered upward, and relatively heavy dust is swept upward. Here, the swept heavy dust is continuously swept up by the guide portion 11*a*, thereby being collected in the first collecting region 40.

Also, the light dust passes through the first collecting region 40, and is increased in flow rate while passing through the accelerating portion 43 having a flow path with a reduced sectional area. As a result, the light dust can be moved upward into the second collecting region 50 through the connection passage 21. Once the light dust is moved upward and collected in the second collecting region 50, the dividing member 52 can prevent the dust from flowing backward into the first collecting region 40.

Then, if the user finishes operation of the robot cleaner 1, the operations of the blower 30 and the rotating brush 14 are stopped. With the stoppage of the blower 30, the backflow preventing member 41 provided in the first collecting region 40 is returned to the original position thereof to close the suction hole 11, thereby preventing the dust collected in the dust collector 20 from being discharged through the suction hole 11.

As a result, the dust collector 20 included in the robot cleaner 1 according to the first embodiment can separately collect relatively heavy dust in the first collecting region 40 defined in the lower part thereof, and relatively light dust in the second collecting region 50 defined in the upper part thereof.

The dust collected in the dust collector 20 can be removed from the robot cleaner 1 when the robot cleaner 1 docks with the docking station (not shown). Also, the heavy dust collected in the first collecting region 40, which is not removed by a suction force of the docking station, can be removed as the user pivotally rotates the backflow preventing member 41 that closes the suction hole 11 with his/her finger, etc.

In the case of the robot cleaner 1 according to the first embodiment, although it uses the relatively small-scale blower 30 having a low suction performance, it can sweep up the heavy dust into the first collecting region 40 by rotations of the rotating brush 14, and simultaneously, can collect the relatively light dust in the second collecting region 50 by the suction force of the blower 30. As a result, the robot cleaner 1 can achieve a maximum cleaning performance even with a compact configuration thereof, and can prevent the collected dust from being discharged through the suction hole 11 by use of the backflow preventing member 41 provided in the first collecting region 40.

Next, a robot cleaner according to a second embodiment will be described.

In the following description, the same configurations as those of the robot cleaner according to the previously described first embodiment will be designated by the same reference numerals and a description thereof will be omitted.

The robot cleaner according to the second embodiment is approximately the same as the robot cleaner according to the first embodiment except for the configuration of a dust collector.

Figure 6:
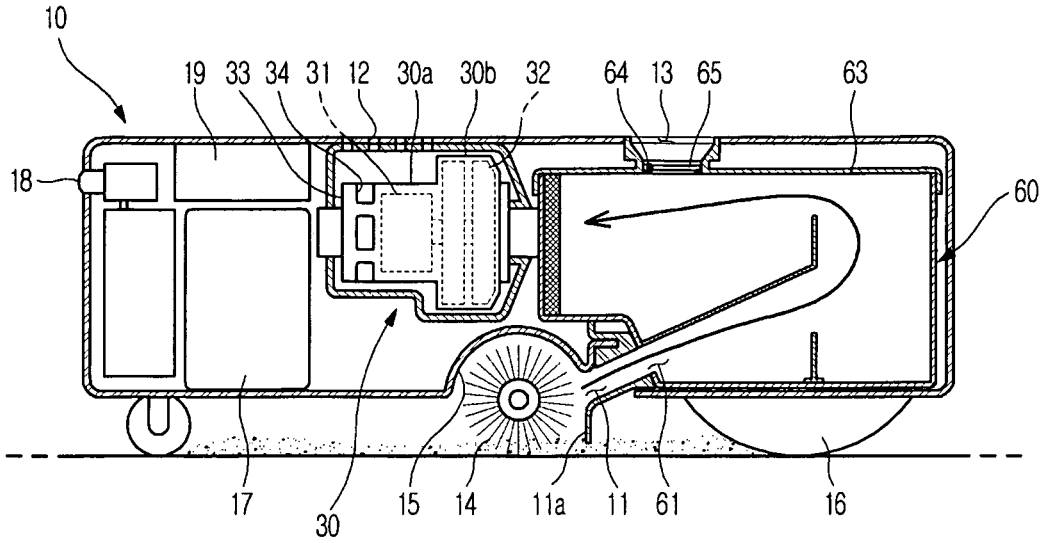
FIG. 6 is a sectional view illustrating the overall configuration of a robot cleaner according to a second embodiment.
Figure 7:
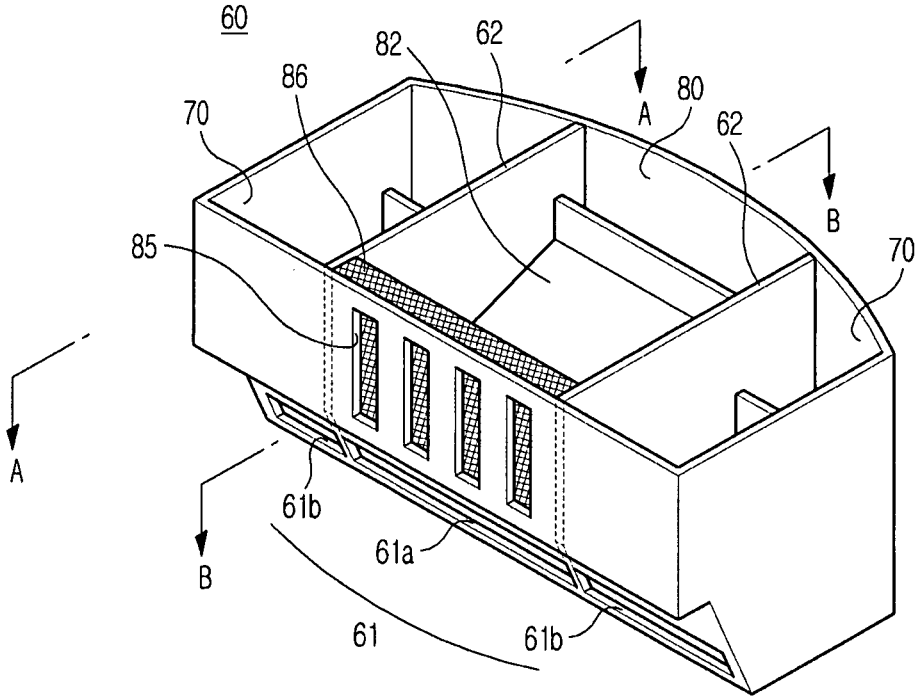
FIG. 7 is a perspective view illustrating a dust collector included in the robot cleaner according to the second embodiment.
Figure 8:
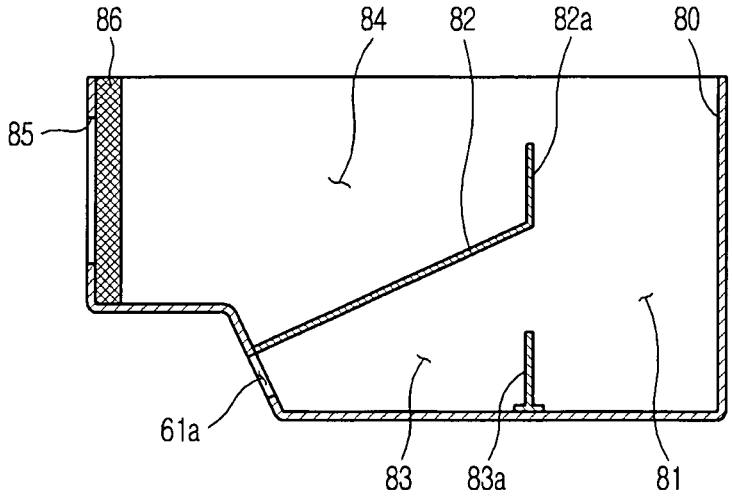
FIG. 8 is a sectional view taken along the line A-A of FIG. 7.
Figure 9:
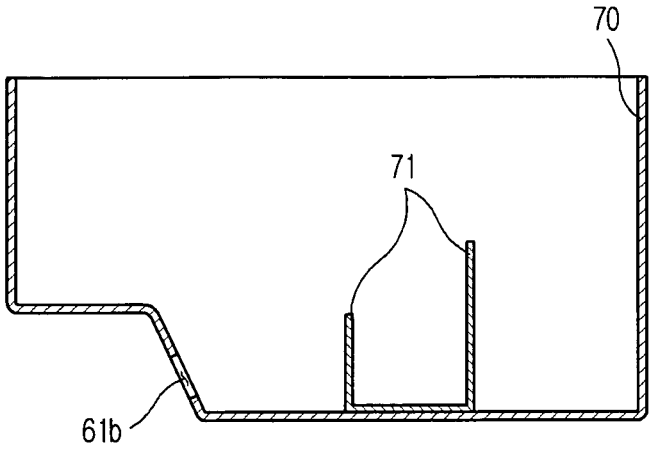
FIG. 9 is a sectional view taken along the line B-B of FIG. 7.

FIG. 6 is a sectional view illustrating the overall configuration of the robot cleaner according to the second embodiment. FIG. 7 is a perspective view illustrating a dust collector included in the robot cleaner according to the second embodiment. Also, FIG. 8 is a sectional view taken along the line A-A of FIG. 7, and FIG. 9 is a sectional view taken along the line B-B of FIG. 7.

The dust collector 60 included in the robot cleaner according to the second embodiment, as shown in FIG. 6, has an approximately rectangular box shape. The dust collector 60 has suction slots 61, 61*a* and 61*b* formed in a lower portion thereof to have a total size corresponding to that of the suction hole 11, and an upper portion of the dust collector 60 is configured to communicate with the blower 30.

As the blower 30 and the rotating brush 14 are operated, dust on the floor can be collected into the dust collector 60.

The dust collector 60 includes a top cover 63. The top cover 63 is formed with an opening 64 to communicate with the dust-discharge hole 13 and an opening/closing device 65 to open or close the opening 64. Once the robot cleaner 1 docks with the docking station, the opening/closing device 65 opens the opening 64, to remove the dust collected in the dust collector 60 through the opening 64 and the dust-discharge hole 13.

The interior of the dust collector 60, as shown in FIG. 7, is divided into a plurality of collecting regions 70 and 80. More specifically, the dust collector 60 includes a pair of first collecting regions 70 to collect dust swept up by a rotating force of the rotating brush 14, and a second collecting region 80 separated from the first collecting regions 70 by a plurality of vertical partitions 62 and configured to communicate with the blower 30 to collect dust on the floor by use of the suction force of the blower 30 and the rotating force of the rotating brush 14.

The suction slots 61 include first suction slots 61*b* formed along lower ends of the respective first collecting regions 70, and a second suction slot 61*a* formed along a lower end of the second collecting region 80.

With the above described configuration, dust introduced into the first suction slots 61*b* is collected in the first collecting regions 70, and dust introduced into the second suction slot 61*a* is collected in the second collecting region 80. As a result, the dust collected in the first collecting regions 70 is not mixed with the dust collected in the second collecting region 80.

The pair of first collecting regions 70, as shown in FIGS. 7 and 9, is separated from the second collecting region 80 by the vertical partitions 62, and are hermetically sealed except for the first suction slots 61*b*.

Since the first collecting regions 70 are not in communication with the blower 30, they are not adapted to collect dust by the suction force of the blower 30. Only relatively heavy dust is swept up and collected into the first collecting regions 70 only by the rotating force of the rotating brush 14.

Each of the first collecting regions 70 has an approximately horizontal bottom surface, and is provided at a bottom surface thereof with at least one wall piece 71 having a predetermined height to prevent the collected dust from being discharged to the outside through the second suction slot 61*a*.

The second collecting region 80, as shown in FIGS. 7 and 8, is divided into upper and lower double-stage collecting regions by a dividing member 82, to define a suction path 81 along which dust will be suctioned by operation of the blower 30 and to allow the dust to be sorted and collected according to the weight thereof.

Specifically, the second collecting region 80 includes a lower collecting region 83 defined in a lower part thereof to receive relatively heavy dust, and an upper collecting region 84 defined above the lower collecting region 83 to receive relatively light dust.

The lower collecting region 83 provides a collecting space for relatively heavy dust, and has an approximately horizontal bottom surface. The lower collecting region 83 is provided at the bottom surface thereof with a wall piece 83*a* having a predetermined height to prevent the dust collected in the lower collecting region 83 from being discharged to the outside through the suction slot 61*b*.

The upper collecting region 84 is in communication with the lower collecting region 83 to collect relatively light dust. The upper collecting region 84 has communicating slots 85 for the blower 30, and in turn, the communicating slots 85 are covered with a filter 86 to purify the air suctioned by the blower 30 and discharge the purified air to the outside.

The dividing member 82 is inclined upward toward the rear side. One end of the dividing member 82 is formed with a vertically-extending portion 82*a* to prevent the dust collected in the upper collecting region 84 from flowing backward into the lower collecting region 83.

With the above described configuration, relatively light dust is collected in the upper collecting region 84 by passing through the lower collecting region 83 by the suction force of the blower 30 and the rotating force of the rotating brush 14. Also, relatively heavy dust is swept up and collected in the lower collecting region 83 by the rotating force of the rotating brush 14.

Hereinafter, operation of the robot cleaner according to the second embodiment will be described with reference to the drawings.

If the user starts the robot cleaner 1, the blower 30 and the rotating brush 14 are operated. With the operation of the rotating brush 14, relatively heavy dust is swept up and collected into the first and second collecting regions 70 and 80 through the first and second suction slots 61*b* and 61*a*.

In this case, the guide portion 11*a* provided at the suction hole 11 of the body 11 acts to allow the dust swept up by the rotating brush 14 to be easily introduced into the first and second collecting regions 70 and 80.

Also, with the operation of the blower 30, dust can be introduced into the second collecting region 80, which is in communication with the blower 30, through the second suction slot 61*a* by the suction force of the blower 30 and the rotating force of the rotating brush 14.

In this case, relatively heavy dust is swept up by the rotating brush 14 and collected in the lower collecting region 83 of the second collecting region 80. Also, relatively light dust is first scattered upward by the rotating brush 14 and then collected into the upper collecting region 84 by passing through the lower collecting region 83 by the suction force of the blower 30.

By allowing the first collecting regions 70 to collect the dust only by the rotating force of the rotating brush 14, and the second collecting region 80 to collect the dust by interaction of the rotating force of the rotating brush 14 and the suction force of the blower 30, an improved cleaning efficiency can be accomplished.

Furthermore, in the plurality of first and second suction slots 61 corresponding to the suction hole 11 of the body 10, since the second suction slot 61*a* of the second collecting region 80 has a smaller sectional area than that of the suction hole 11 of the body 10, it provides a smaller air-suction path than the prior art, thereby achieving a strengthened suction force.

As a result, even when using a blower having the same capacity as the prior art, it is possible to suction dust scattered upward by the rotating brush with a stronger suction force than the prior art, and to sweep up relatively heavy and bulky dust by use of the rotating brush in the same manner as the prior art.

As apparent from the above description, the present embodiments provide a robot cleaner having the following several effects.

First, the robot cleaner according to the present embodiments can sweep up, for example, relatively heavy dust by use of a rotating brush and a first collecting region defined in the lower part of a dust collector, and simultaneously can collect, for example, relatively light dust by a suction force generated by a blower, resulting in an improved cleaning performance.

Secondly, by defining first and second collecting regions in the single dust collector to allow dust to be sorted and collected according to the weight thereof, it is possible to further improve the cleaning performance and to facilitate the discharge of dust collected in the dust collector.

Third, with the provision of a backflow preventing member in the dust collector, the present embodiments have the effect of preventing the dust collected in the dust collector from being discharged to the outside through a suction hole.

Fourth, by virtue of a guide portion provided at the suction hole, it is possible to improve a sweeping efficiency for heavy dust, etc.

Fifth, according to the present embodiments, the dust collector may include a plurality of suction slots each having a smaller cross area than the suction hole. This has the effect of not only increasing a suction force of the blower, but also allowing dust to be efficiently swept up by a rotating force of the rotating brush, resulting in an improved cleaning performance.

Sixth, when the suction slots include a first suction slot to suction dust by operations of the rotating brush and the blower, and second suction slots to suction dust only by operation of the rotating brush, the present embodiment can achieve an improved ability to collect a variety of dust having different sizes from each other.

Although embodiments have been shown and described, it would be appreciated by those skilled in the art that changes may be made in these embodiments without departing from the principles and spirit of the invention, the scope of which is defined in the claims and their equivalents.

What is claimed is:

1. A robot cleaner, comprising:

a suction hole to suction dust;

a blower to generate a suction force;

a rotating brush provided at a side of the suction hole;

a dust collector to receive the dust suctioned through the suction hole, the dust collector including a plurality of collecting regions including a first collecting region defined in a lower part of the dust collector and configured to sweep up and collect heavy dust of the dust by a drive force of the rotating brush, a second collecting region defined in an upper part of the dust collector above the first collecting region and configured to collect light dust lighter than the heavy dust by the suction force of the blower, and a connection passage to communicate the first and second collecting regions; and a guide portion to guide the dust swept up by the rotating brush into the suction hole, wherein the first collecting region has a horizontal lower surface, the guide portion extending from the horizontal lower surface and being inclined downward so that the entire guide portion is below the first collecting region, and wherein the dust collector is partitioned to form the first collecting region and the second collecting region connected by the connection passage by a single dividing member fixed within the dust collector and protruding upward from a bottom of the second collecting region to prevent the dust collected in the second collecting region from flowing backward into the first collecting region through the connection passage, the dividing member being disposed in the internal space of the dust collector.

2. A robot cleaner, comprising:

a body having a suction hole to suction dust;

a blower provided in the body to generate a suction force;

a rotating brush provided at a side of the suction hole;

a dust collector to receive the dust suctioned through the suction hole, the dust collector including at least one first collecting region to receive heavy dust of the dust swept up by the rotating brush, and a second collecting region to receive light dust lighter than the heavy dust introduced by interaction of the rotating brush and the blower above the first collecting region, the first collecting region communicating with the second collecting region via a connection passage; and a guide portion to guide the dust swept up by the rotating brush into the suction hole, wherein the first collecting region has a horizontal lower surface, the guide portion extending from the horizontal lower surface and inclined downward so that the entire guide portion is below the first collecting region, and wherein the dust collector is provided with an internal space, the internal space being partitioned to form the first collecting region, the second collecting region and the connection passage by a single dividing member fixed within the dust collector and protruding upward from a bottom of the second collecting region to prevent the dust collected in the second collecting region from flowing backward into the first collecting region through the connection passage.

3. The robot cleaner according to claim 2, wherein the suction hole and a lower surface of the first collecting region are provided at a bottom of the body to be located close to the floor.

* * * * *

UNITED STATES PATENT AND TRADEMARK OFFICE

CERTIFICATE OF CORRECTION

PATENT NO. : 8,627,542 B2
APPLICATION NO. : 12/076780
DATED : January 14, 2014
INVENTOR(S) : Kim et al.

It is certified that error appears in the above-identified patent and that said Letters Patent is hereby corrected as shown below:

On the Title Page Item [75] (Inventors), Line 5, Delete "Hwawseong-si (KR)" and insert -- Hwaseong-si (KR) --, therefor.

Signed and Sealed this
First Day of July, 2014

Michelle K. Lee

Michelle K. Lee
*Deputy Director of the United States Patent and Trademark Office*